US005795166A

United States Patent [19]

Meixler

[11] Patent Number: 5,795,166

[45] Date of Patent: Aug. 18, 1998

[54] SELF CONTAINED CHILD RESISTANT ELECTRICAL PLUG SAFETY LOCK

[76] Inventor: Lewis D. Meixler, 11 Cherry Brook La., E. Windsor, N.J. 08520

[21] Appl. No.: 393,204

[22] Filed: Feb. 23, 1995

[51] Int. Cl.[6] ..... H01R 13/44

[52] U.S. Cl. ..... 439/134; 439/149

[58] Field of Search ..... 439/133, 134, 439/149

[56] References Cited

U.S. PATENT DOCUMENTS 3,416,123 12/1968 Husebo ..... 439/134

4,060,297 11/1977 Marshall et al. ..... 439/149

5,176,527 1/1993 Herbert ..... 439/134

5,277,600 1/1994 Meixler ..... 439/134

*Primary Examiner*—Neil Abrams

[57] ABSTRACT

This invention relates generally to the field of devices designed to prevent the use of electrical equipment or appliances by securing the electrical plug. More specifically this invention relates to a device which will captivately surround the blades of the electrical plug in such a manner that young children, elderly persons, or mentally retarded persons cannnot gain access to their use, and which incorporates a clamping mechanism which can be actuated without the use of any external apparatus, such as a key or a tool.

8 Claims, 2 Drawing Sheets

SELF CONTAINED CHILD RESISTANT ELECTRICAL PLUG SAFETY LOCK

BACKGROUND

Field of the Invention

This invention relates generally to the field of devices designed to prevent the use of electrical equipment or appliances by securing the electrical plug, and more specifically to a device which will captively surround the prongs of the electrical plug in such a manner that young children, elderly persons, or mentally retarded persons cannot gain access to the use of the appliance. Specifically, this invention incorporates a locking mechanism which can be actuated without the use of a key or a tool.

Document Disclosure

Attention is drawn to Document Disclosure number 337311, dated Aug. 4, 1993 entitled Child Safety Plug Lock, and Child Proof Knob.

Description of the Prior Art

The prior art is rich with devices to prevent small children from being able to gain access to various household electrical appliances. The potential for injury and fire hazard to themselves or others from electrical saws, electric drills, soldering irons, clothes irons, toasters, etc. is a serious concern. Also, there are household appliances, to which parents may wish to restrict use by their young children such as televisions, radios, computers, or various electronic games. Additionally, it is desirable for the device to be convenient to operate, and not require any special external apparatus such as tools or keys. Furthermore the proposed device should be inexpensive to manufacture so that the public can easily afford the number of safety devices necessary to secure all of the appropriate appliances in a household.

A number of devices have been proposed whose purpose it is to render the use of electrical plugs inaccessible. U.S. Pat. Nos. 2,955,272, 2,844,805, 4,488,764, 4,666,224, and 4,673,230 all attempt to render the entire plug inaccessible by placing the plug within a locked enclosure. These devices are unsightly and are necessarily large and unwieldy as a household or office item if they are to accommodate all sizes of plugs. U.S. Pat. Nos. 4,640,107, 4,679,873 and 4,812,131 operate by securing the plug into a housing by using a mechanism for capturing the body of the electrical plug thereby attempting to prevent the withdrawal of the plug from the housing. These devices are awkward, will not work uniformly well on all sizes of plug bodies, or are unduly complicated and expensive to manufacture. They may invite attempts to defeat them by being obvious in their operation. U.S. Pat. Nos. 2,733,416, 3,662,320 and 3,543,544 all operate by securing or clamping a lock to the blades of the plug using various locking mechanisms. Furthermore, U.S. Pat. Nos. 2,654,073, 3,345,600, 3,539,968, 3,781,913, 4,413,490, 4,563,048 and 4,566,297 utilize the holes in the blades of the plug to secure a locking mechanism. The locking devices which have relied for their operation on the insertion of pins, or the shackle of a padlock through the holes in the blades of the plug have several disadvantages. Any distortion of the alignment of the blades of the plug, which many times occurs with use over an extended period of time, makes the insertion of the pins or shackle very difficult and therefore the locking device difficult to use. Additionally, the holes are the result of manufacturing processes, and are not of uniform diameter, or at a standard distance from the base. Also, some plug manufacturers do not provide plug blades with holes. Furthermore, many of the above devices will not work at all on the three prong type of plugs, because the center or grounding prong will interfere with the operation of the device. U.S. Pat. No. 5,277,600 to L. Meixler issued Jan. 11, 1994, and U.S. Pat. No. 5,176,527 overcome many of these objections, but both require a tool to operate the clamping means.

Objects and Advantages

Accordingly, the main object of this invention to provide a device which is a locking cover which attaches to the blades of an attachment plug of the NEMA 1–15P or 5–15P configurations, commonly known as 2-pole, 2 wire or 2-pole, 3 wire 125 Volt, straight blade type of electrical plugs, which can be secured without any additional tools, parts or keys.

It is a further object of this invention to provide a safety device which can be used to prevent young children from gaining unauthorized access to electrical appliances which is very inexpensive, and easy to manufacture, thereby making it feasible for a family, household, school or other institution to afford as many devices as necessary to provide adequate protection.

Furthermore, it is an object of this invention to use a locking mechanism which employs a Push-Down-and-Turn to Release Knob that can be actuated without the use of a tool, or their equivalents. The Push-Down-and-Turn to Release Knob is a procedure which is similar to the child resistant bottle caps used for household medicines and vitamins, and therefore familiar to most parents or child care-givers. An alternate configuration uses a latch to achieve the same locking function, and a third alterative configuration uses a rod and a lever toggle configuration to achieve the locking function.

A further object of this invention is to provide a device which is simple to use, and which will not be objectionable in appearance.

Another object of this invention is the implementation of a device which will be simple enough in operation to enable virtually all adults to operate it, but not so simple that children or adults of limited physical strength or ability can defeat it.

Further objects and advantages of my invention will become apparent from a consideration of the drawings and ensuing description.

DESCRIPTION OF THE DRAWINGS

These and other advantages of the invention will become apparent from the following detailed description, and the accompanying drawings in which.

SUMMARY OF THE INVENTION

Figure 1:
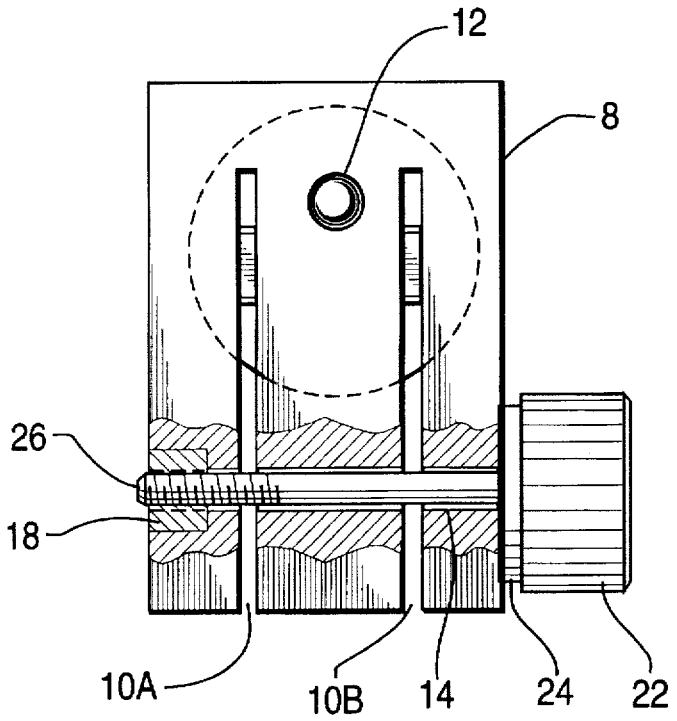
FIG. 1 is a view of the Self Contained Child Resistant Electrical Plug Safety Lock showing the surface into which the electrical plug is inserted to be retained in its captive position, and the Push-Down-and-Turn to Release Knob.

The preferred embodiment of the Self Contained Child Resistant Electrical Plug Safety Lock is illustrated in FIG. 1. The preferred embodiment comprises a block 8 which can be molded, extruded or machined from a strong, machinable, flexible thermoplastics such as Delrin, a nylon (polyhexamethylene-adipamide) available from E. I duPont Nemours, Inc., or from high density polyethylene, polyvinylchloride, polypropylene or polycarbonate. It is also known that endothermic chemical foaming agents or the addition of inert gases can be used with thermoplastics to eliminate processing problems such as sink marks, warpage, or stresses, as well as achieving weight reduction and cost savings in molded or extruded parts during the production of foamed plastic parts. Such foamed plastic parts can be classified as either thermoset, thermoplastics, or thermoplastic elastomers, and the relative merits and disadvantages of each are well known in the art. Wood, compositions of wood and metal, or other flexible materials such as hard rubber may be used for block 8. Block 8 has a pair of grooves 10*a* and 10*b* typically 1/16 inch wide spaced at the appropriate distances to accommodate the parallel blades of a standard electrical plug. Grooves 10*a* and 10*b* cause the formation of a trifurcated portion in block 8. Grooves 10*a* and 10*b* may be fabricated by machining, molding, or as part of the extrusion process. Furthermore, grooves 10*a* and 10*b* may have their edges chamfered to aid in the insertion of the plug blades into the block. Additionally, block 8 has a hole 12, typically ¼ inch in diameter spaced at the proper location between grooves 10*a* and 10*b* to receive the third, or grounding prong of the electrical plug. Hole 12 may be formed by molding, drilling, or extrusion, and may be a through hole or a blind hole. In the preferred embodiment of the Self Contained Child Resistant Electrical Plug Safety Lock illustrated in FIG. 1, an additional hole 14, intersecting grooves 10*a* and 10*b*, receptive of a Push-Down and Turn Mechanism, exists at right angles to the direction of insertion of the plug.

Figure 2:
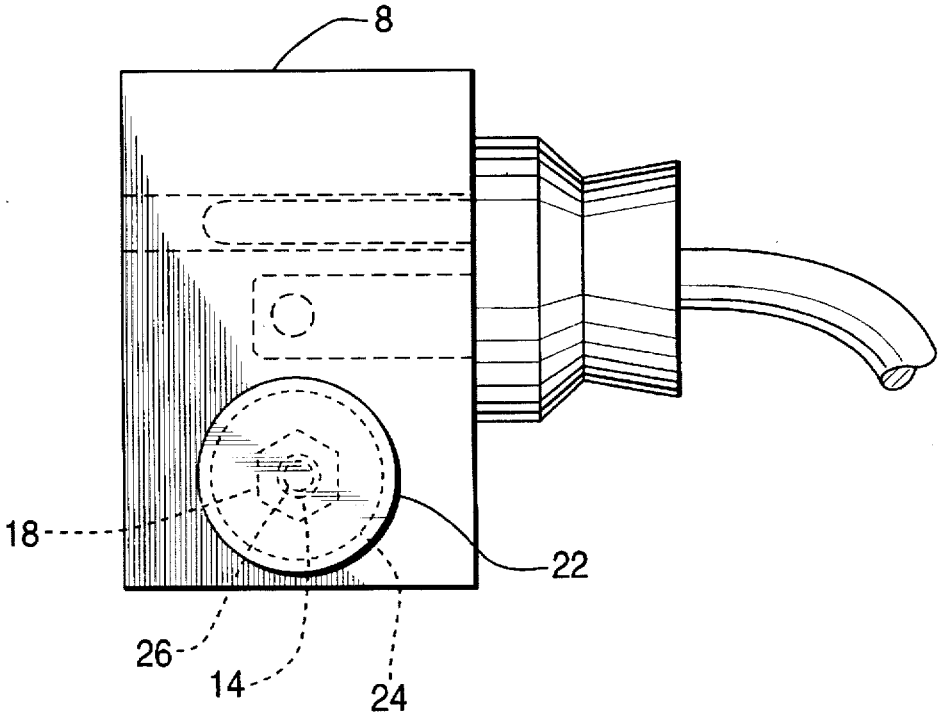
FIG. 2 is a side view of the Push-Down-and-Turn mechanism, comprised of the Push-Down-and-Turn to Release Knob and a threaded shaft.

The Push-Down-and-Turn Mechanism, shown in FIG. 1, is comprised of a Push-Down-and-Turn to Release Knob, a centering insert and a threaded shaft. The Push-Down-and-Turn to Release Knob 22, is comprised of an inner cap and an outer cap. A typical Push-Down-and-Turn to Release Knob is embodied in commercial safety bottle cap number 20/400 provided by Penn Bottle and Supply Company of Philadelphia, Pa. Tightening rotation is accomplished by turning the Push-Down-and-Turn to Release Knob in the clockwise direction, with very moderate downward pressure on the cap. Loosening rotation is accomplished by turning the Push-Down-and-Turn to Release Knob in the counter-clockwise direction, but considerable downward force is necessary for the rotation to be transmitted from the outer cap to the inner cap. It is this downward force which renders the Push-Down-and-Turn Mechanism resistant to operation by children, and others with limited physical strength. A centering insert 24 is secured within the push-down-and-turn mechanism by epoxy, glue, cement or other means. The centering insert 24 serves to hold and position a threaded shaft 26 axially within the Push-Down-and-Turn mechanism. The centering insert 24 extends beyond the edge of the Push-Down-and-Turn mechanism to prevent the mechanism from bottoming out when fully tightened, thereby preventing the mechanism's release. Alternatively, Block 8 can have a raised surface to accomplish the equivalent function. Hole 14, which is receptive of threaded shaft 26, has a clearance region through the middle trifurcated section, and also the trifurcated section adjacent to the Push-Down-and-Turn Mechanism, but has a threaded region at the trifurcated section which is opposite the Push-Down-and-Turn Mechanism. The threaded section is identified as surface 18. Surface 18 may be a threaded region in block 8 or may be a separate threaded insert molded into block 8 such as a nut as shown in FIG. 1. Threaded shaft 26 is of the appropriate length to traverse the width of the block when fully tightened into the block after engaging threaded surface 18. In operation, the plug is inserted into the block with the plug blades located within grooves 10*a* and 10*b*, and then the Push-Down-and-Turn Mechanism is tightened squeezing the trifurcated region of Block 8 to retain and capture the plug blades. FIG. 2 shows a side view with the plug inserted.

Figure 3:
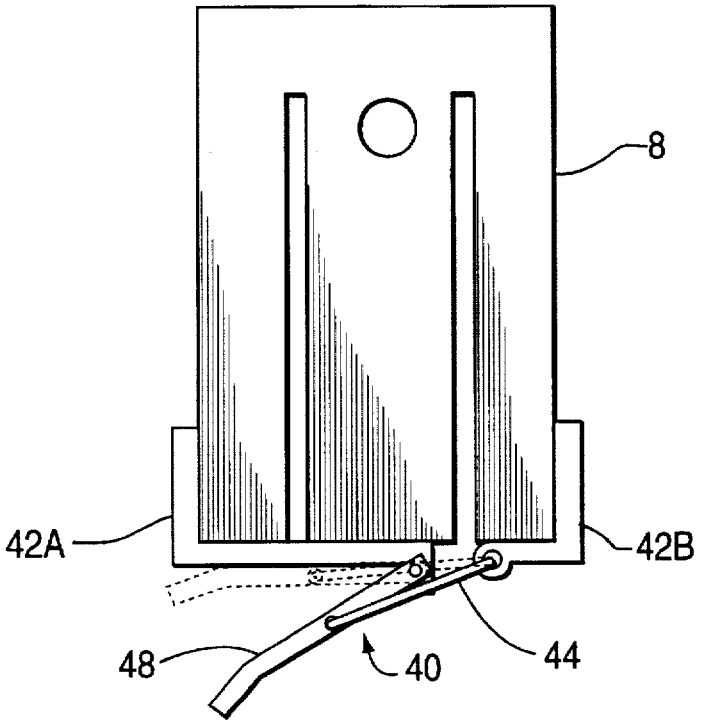
FIG. 3 is an alternate embodiment of the Self Contained Child Resistant Electrical Plug Safety Lock in which the clamping function is derived from a latching locking configuration, of the type commonly used on ammunition cases .

FIG. 3 shows an alternate embodiment to FIG. 1, in which a latching mechanism 40, is used to apply clamping force onto the blades of an inserted plug. The latching mechanism is comprised of a first gripping member, 42A, and a second gripping member 42B. A linkage 44 connects the second gripping member to a lever 48 which pivots about a pin in the first gripping member 42A. Rotating the lever clockwise about the pivot point causes the application of clamping force.

Figure 4:
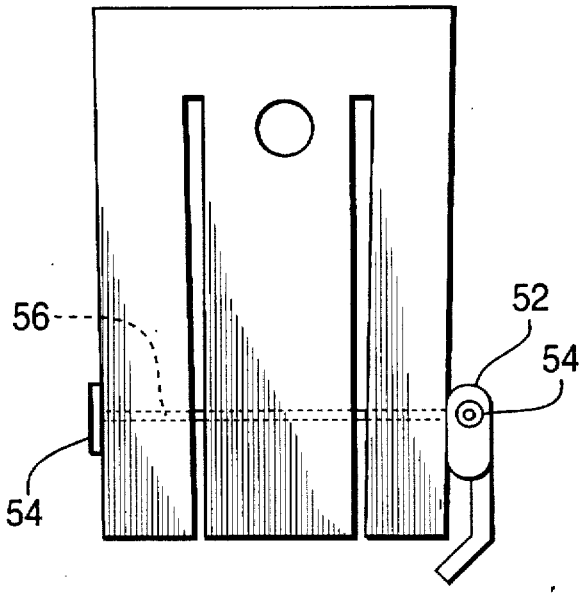
FIG. 4 is another embodiment of the Self Contained Child Resistant Electrical Plug Safety Lock which uses a rod and a lever toggle locking configuration, in the non-clamping position.
Figure 5:
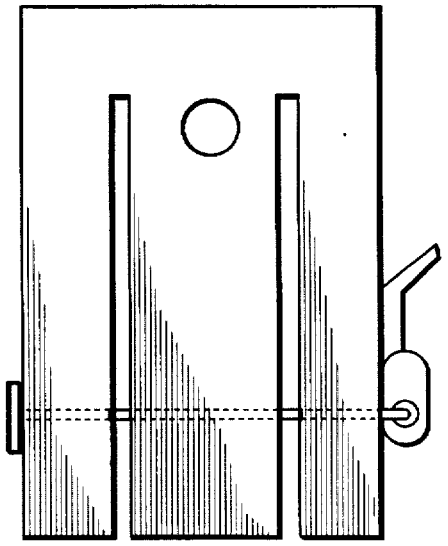
FIG. 5 shows the rod and lever toggle configuration in the clamped position.

FIG. 4 shows an alternate embodiment to FIG. 1, in which a toggle mechanism 52, with an off center hole 54, a rod 56, and an end plate 58 is used to apply clamping force to the blades of an inserted plug. FIG. 4 shows the toggle mechanism in the clamped position, and FIG. 5 shows the unclamped position.

Thus it can be shown that a number of mechanisms may accomplish the function of applying compressive force on the blades of the inserted plug, none of which require an external apparatus, such as a tool or key, but which are of sufficient difficulty or complexity such that a small child or other person of limited physical strength would be discouraged from attempting the removal of the inserted plug.

Operation

FIG. 1 shows the best mode for using the Self Contained Child Resistant Electrical Plug Safety Lock. The electrical plug, which is to be captive, is inserted into block 8 with the parallel blades inserted into the parallel grooves 10*a* and 10*b*, and the optional grounding prong inserted into round hole 12. Once the plug is firmly inserted into block 8, as far as it will go, the Push-Down-and-Turn-mechanism is tightened, thereby firmly clamping the blades of the plug between the trifurcated sections of block 8, preventing release of the plug, unless an extremely large amount of external force is applied to the plug. Such a large force would be beyond the capability of small children or persons of limited physical ability such as elderly persons. The plug is released by pushing down and loosening the Push-Down-and-Turn to Release Knob, turning the knob counter-clockwise, thereby reversing the above procedure. Alternatively, the latching mechanism shown in FIG. 3 can be operated to secure the plug as well as the toggle mechanism of FIGS. 4 and 5 in a similar manner.

Having described the Self Contained Child Resistant Electrical Plug Safety Lock invention, it should be apparent that many substitutions, modifications, and variations of the invention are possible in view of the above teachings. It is therefore to be understood that the invention as taught and described herein is only to be limited to the extent of the breadth and scope of the appended claims:

What is claimed is a Self Contained Electrical Plug Safety Lock which is used in cooperation with an electrical plug which comprises:

1.

a A solid resilient plug prong receiving unit, having a front plug prong receiving surface, a base surface, a rear surface, a first side surface, and a second side surface; said receiving unit having two parallel slots receptive of the parallel prongs of an electrical plug, the slots extending perpendicularly inward from said base surface and traversing from said front surface to said rear surface; forming a first branched region adjacent to said first side, a second branched region centered between said parallel slots, and a third branched region adjacent to said second surface, the three branched regions forming a trifurcated portion of said receiving unit; a first aperture centered between said perpendicular slots extending perpendicularly into said front plug prong receiving surface receptive of a plug grounding prong; and b compressive means for applying, sufficient force on the blades of said electrical plug inserted into said block to prevent the withdrawal of said electrical plug, said compressive means specifically designed to be operable without the need for external apparatus.

2. A plug prong receiving unit as in claim 1 having a second aperture parallel to said front surface extending through said receiving plug unit from said first side surface to said second side surface within said trifurcated portion, said second aperture offset from said first aperture, said second aperture having a non-threaded interior surface in said first branched region, and in said second branched region, and a threaded interior surface in said third branched region, and a means for applying compressive force on the blades of said electrical plug which is comprised of a threaded shaft affixed to a push down and turn to release knob, said threaded shaft rotatably located in said second aperture of said block, and in cooperation with said threaded interior surface, said push down and turn to release knob causing said threaded shaft to advance into said threaded interior surface when rotated in a first direction, and to withdraw from said threaded interior surface when rotated in a second direction, said push down and turn to release knob requiring sufficient axially directed force to prevent rotational slippage when rotated in said second direction, thereby preventing persons with limited physical strength from operating said push down and turn to release knob in said second direction, to transmit sufficient force to the blades of said electrical plug to prevent withdrawal of said electrical plug, said compressive means operable without the need for external apparatus.

3. A plug prong receiving unit as in claim 1 said compressive means comprised of a latching mechanism having a first gripping member affixed to said first branched region, a second gripping member affixed to said third branched region, a lever, and a linkage, said linkage linking said second gripping member to said lever, said lever rotatably pivotal about a fixed point on said first gripping member, from a first position to a second position, about said first gripping member causing said first and second gripping members to be biased towards each other, causing clamping force to be exerted on said trifurcated portion of said block for applying compressive force to said blades of said electrical plug thereby preventing the withdrawal of said electrical plug, said latching mechanism operable without the need for external apparatus.

4. A plug prong receiving unit as in claim 1 having a second aperture parallel to said front surface extending through said receiving plug unit from said first side surface to said second side surface within said trifurcated portion, said second aperture offset from said first aperture, said compressive force means comprised of a toggle mechanism having, a rounded block containing a hole parallel to the direction of plug insertion, said hole displaced from the axis of symmetry of said rounded block and a toggle handle affixed to said rounded block, said toggle mechanism further comprising a rod traversing said trifurcated portion, through said second aperture, and an end plate attached to a first end of said traversing rod, said end plate parallel and adjacent to the outside of said third branched region, a second end of said traversing rod pivotably attached and rotatable within said off center hole, said toggle handle rotatable axially around said off center hole, and having a first position for applying clamping force to said trifurcated portion, said force transmissible to said blades of said inserted plug, and a second position for releasing said clamping force, said toggle mechanism operable without the need for external apparatus.

5. An electrical plug safety lock comprising:

a resilient member including at least one aperture for receiving at least one prong of an electrical plug; and compressive means for applying a compressive force on the resilient member to prevent withdrawal of the at least one prong from the at least one aperture when the at least one prong is inserted into the at least one aperture, the compressive means specifically designed to be operable without the need for an external apparatus.

6. An electrical plug safety lock as in claim 5 wherein the resilient member includes a threaded interior surface and the compressive means includes a threaded shaft affixed to a push down and turn to release knob, said threaded shaft being in a cooperative relationship with respect to the threaded interior surface such that a turning of the push down and turn to release knob in a first direction causes the threaded shaft to advance into the threaded interior surface to thereby exert the compressive force on the resilient member and a subsequent turning of the push down and turn to release knob in a second direction causes the threaded shaft to withdraw from the threaded interior surface to thereby remove the compressive force from the resilient member.

7. An electrical plug safety lock as in claim 5, wherein the compressive means includes a latching mechanism having a first gripping member, a second gripping member, a lever, and a linkage, wherein the first and second gripping members engage respectively sides of the resilient member and the linkage links the second gripping member to the lever, wherein the lever is rotatably pivotal between a first position and a second position about a point on the first gripping member, and wherein a pivoting of the lever in the first position urges the first and second gripping members towards each other to thereby exert the compressive force on the resilient member and a pivoting of the lever in the second position urges the first and second gripping members away from each other to thereby remove the compressive force from the resilient member.

8. An electrical plug safety lock as in claim 5, wherein the compressive means includes a toggle mechanism comprising a rounded member have a hole displaced from an axis of symmetry of the rounded member, a rod extending through the resilient member, and an end plate attached to a first end of the rod, a second end of the rod being pivotally attached and rotatable within the hole, and a handle rotatably pivotal between a first position and a second position about the hole, and wherein a pivoting of the handle in the first position urges the rounded member and the end plate towards each other to thereby exert the compressive force on the resilient member and a pivoting of the handle in the second position urges the rounded member and the end plate away from each other to thereby remove the compressive force from the resilient member.

* * * * *